US006072686A

United States Patent [19]

Yarbrough

[11] Patent Number: 6,072,686

[45] Date of Patent: Jun. 6, 2000

[54] MICROMACHINED ROTATING INTEGRATED SWITCH

[75] Inventor: Allyson D. Yarbrough, Hermosa Beach, Calif.

[73] Assignee: The Aerospace Corporation, El Segundo, Calif.

[21] Appl. No.: 09/210,515

[22] Filed: Dec. 11, 1998

[51] Int. Cl.[7] ..... H01P 1/10

[52] U.S. Cl. ..... 361/234; 361/233; 200/181

[58] Field of Search ..... 361/230–235; 200/181

[56] References Cited

U.S. PATENT DOCUMENTS 5,121,089 6/1992 Larson ..... 200/181

OTHER PUBLICATIONS

"Integrated Fabrication of Polysilicon Mechanism", M.Mehregany, K.J. Gabriel, W.S.N. Trimmer, IEEE Transactions on Electron Devices, vol. 35, No. 6, Jun. 1988.

"A Surface Micromachined Miniature Switch for Telecommunications Applications with Signal Frequencies from DC Up to GHZ", J. Jason Yao and M. Frank Chang, Proceedings of the 8th International Conference on Solid State Sensors and Acuators and Eurosensors IX, pp. 384–387, Jun. 25–29, 1995.

*Primary Examiner*—Fritz Fleming
*Attorney, Agent, or Firm*—Derrick Michael Reid

[57] ABSTRACT

A microelectromechanical system (MEMS) switch has a bidirectionally rotating member having two positions for integrated circuit connection. The switch is formed on a circular standoff bearing for rotating the switch in the plane of the substrate using conventional processing techniques. Control traces carry electrical signals generating electrical fields to provide an electro-static force upon the rotating switch member to rotate the switch clockwise or counter-clockwise to position and maintain it in either of two positions. The MEMS switch has wide applications to a variety of microelectromechanical system circuit applications.

6 Claims, 3 Drawing Sheets

F1 POSITIONED MEMS INTEGRATED SWITCH

F1 POSITIONED MEMS INTEGRATED SWITCH

F2 POSITIONED MEMS INTEGRATED SWITCH

MICROMACHINED ROTATING INTEGRATED SWITCH

STATEMENT OF GOVERNMENT INTEREST

The invention was made with Government support under contract No. F04701-93-C-0094 by the Department of the Air Force. The Government has certain rights in the invention.

FIELD OF THE INVENTION

The present invention relates to the field of microelectromechanical systems (MEMS) device structures and fabricating methods. More particularly, the present invention is directed to a rotating MEMS switch well suited for combination with microelectronic filters for monolithic millimeter wave applications.

BACKGROUND OF THE INVENTION

On-call mobile communications demand compact, high-performance electronic systems. Many of these systems are being deployed in high-volume applications, such as hand-held phone sets and satellite TV receivers, where improved packaging efficiencies and capabilities at low cost are crucially important. Adopting a highly-integrated design, one that employs compact packaging and monolithic circuits, is one way to ensure meeting these requirements. The MEMS (microelectromechanical systems) and micromachining technologies offer viable potential solutions to the challenges in these critical communications device areas.

Many current electronic communication designs employ hybrid technology, wherein discrete components such as individual transistors, diodes, resistors, capacitors, and inductors, are bonded or soldered to one or more interconnected microelectronic substrates. This hybrid approach necessarily involves many interfaces and connections, leading to increased potential for impedance mismatch or signal loss, with associated increasing size, complexity and reduced reliability. Integrating components and interconnections onto a single substrate enhances performance by eliminating such circuit interfaces to reduce signal losses while also achieving a light-weight, compact design.

One device routinely needed in a wide variety of microelectronic applications is the electrical switch. There have been many types of electrical switches made, including electronically activated toggle and rotary electrical switches. Also, large discrete electromechanical rotary switches have been used for years.

MEMS gears with bearings have also been fabricated. A MEMS bearing is a hub support structure upon which is rotated a member that is raised and supported above the surface of a substrate. One such rotating member is a gear rotating unidirectionally in a plane parallel to the surface of the substrate. MEMS gears have not been fashioned into rotating switches, rotating in a plane parallel to the surface of the substrate. However, orthogonal electrical MEMS switches, with members moving orthogonal to the plane of the substrate have been fabricated. One such orthogonal electrical MEMS switch comprises a flexing cantilever structure extending above a substrate surface, comprises an electrical field generating structure suspended above the substrate, and comprises a plurality of contact points on the substrate below the cantilever structure. As the electrical field is varied, the cantilever structure flexes orthogonally to the plane of the substrate to bring the flexing contact structure on to the substrate surface to any one of the contact points to thereby make an electrical switch connection with any one of the contact points to the flexing contact structure. As the electrical field is unidirectionally varied, the flexing contact structure flexes in an amount depending on the strength of the electrical field. During electrical contact, the flexing contact structure is disadvantageously stressed. This and other disadvantages are solved or reduced using the invention.

SUMMARY OF THE INVENTION

An object of the invention is to provide a microelectromechanical system (MEMS) rotating switch.

Another object of the invention is to provide a bidirectionally operated MEMS rotating switch.

Another object of the invention is to provide a bidirectionally operated MEMS rotating switch using opposing electrical fields.

The invention is directed to a MEMS rotating switch suitable for switching circuits in a wide variety of circuit applications, including, for example, a filter network in millimeter wave receivers. The MEMS rotating switch is fabricated using micromachining technology to achieve a compact configuration. This switch can be manufactured cost-effectively while taking advantage of semiconductor batch fabrication processes. The switch includes a rotating member coupled to a substrate using a MEMS retaining structure about which the switch rotates. Opposing electrical fields are intermittently generated to provide a static motive force upon the rotating member to rotate the switch into and maintain it in respective positions. These and other advantages will become more apparent from the following detailed description of the preferred embodiment.

DETAILED DESCRIPTION OF THE PREFERRED EMBODIMENT

Figure 1:
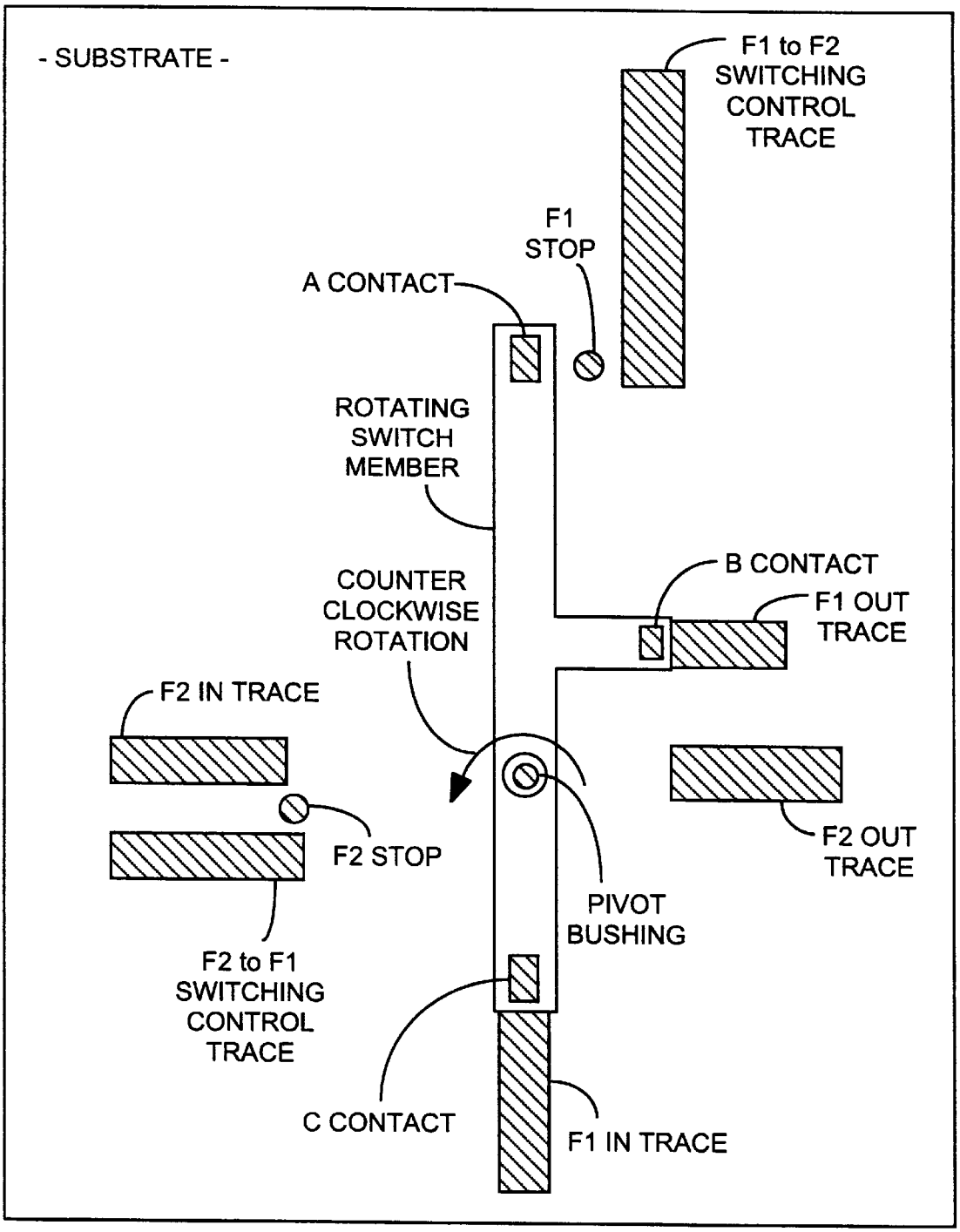
FIG. 1 is a drawing of a microelectromechanical system (MEMS) integrated switch in a first F1 position.
Figure 2:
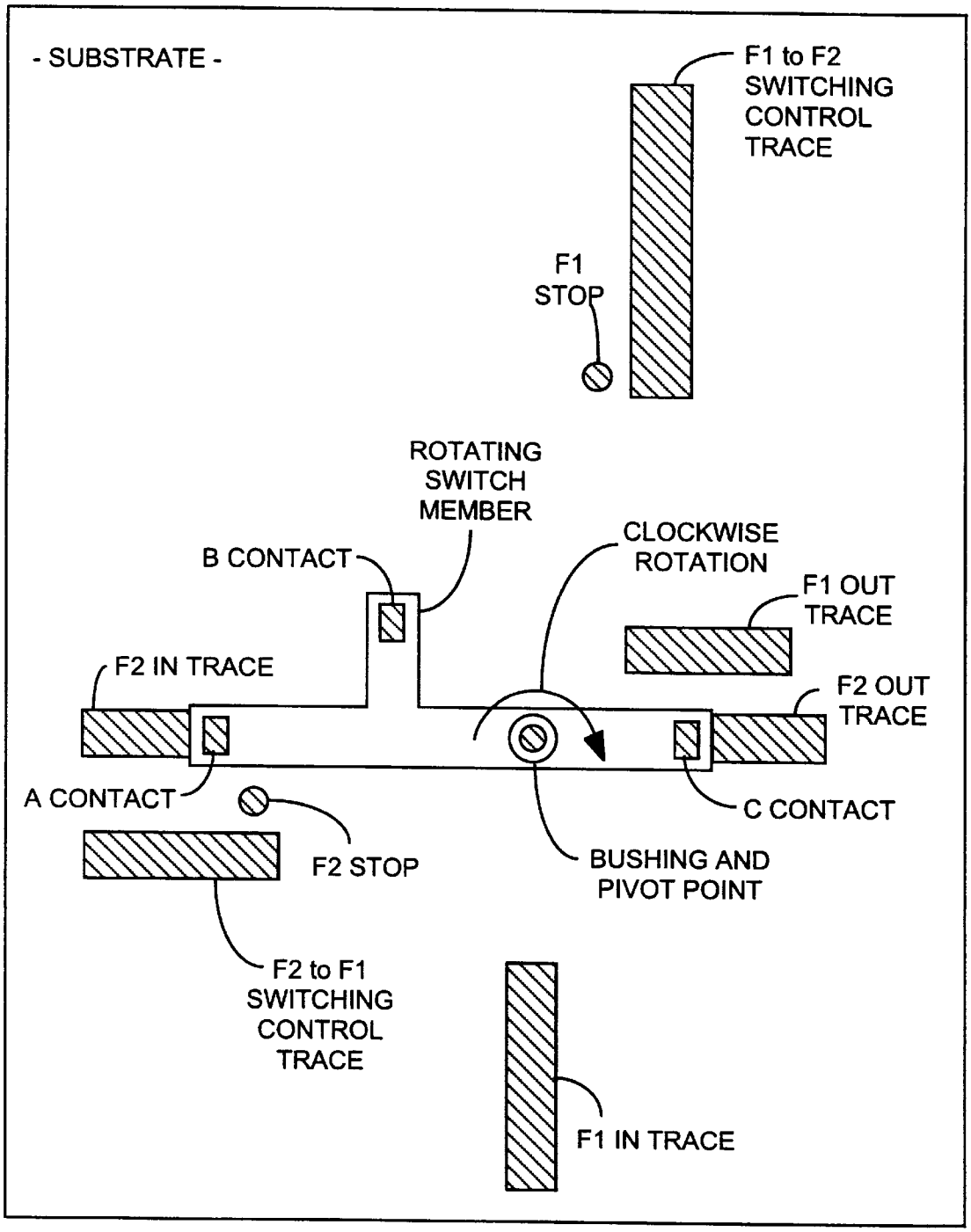
FIG. 2 is a drawing of a microelectromechanical system, (MEMS) integrated switch in a second F2 position.

An embodiment of the invention is described with reference to the figures using reference designations as shown in the figures. Referring to FIGS. 1 and 2, a microelectromechanical system (MEMS) integrated switch is shown having a rotating switch member disposed upon a retaining structure centered in a precision through-hole in a film atop a substrate. The rotating member is conductive or has conductive traces disposed upon it. The rotating member is shown in FIG. 1 in an F1 (Frequency 1) position and in FIG. 2 in an F2 (Frequency 2) position. The rotating member, in the F1 position, connects an F1 In trace through a C contact to an F1 Out trace through a B contact. The rotating member, in the F2 position, connects an F2 In trace through an A contact to an F2 Out trace through the C contact. Referring to FIG. 1, the rotating member is electrostatically driven through a counter-clockwise rotation from the F1 position to the F2 position by providing an electrical signal on an F1 to F2 switching control trace generating a small electrical field to repel the rotating member at the A contact point to counter-clockwise rotate the rotating member until the rotating member hits the F2 stop achieving the F2 position. Referring to FIG. 2, the rotating member is electrostatically driven through a clockwise rotation from the F2 position to the F1 position by providing an electrical signal on an F2 to F1 switching control trace generating a small electrical field to repel the rotating member at the A contact point to clockwise rotate the rotating member until the rotating member hits an F1 stop achieving the F1 position. The rotating switch member has the A, B and C contacts sized so that connection between the F1 In and Out traces or the F2 In and Out traces are connected together to complete a switch circuit connection. Depending on the direction and strength of the electrostatic excitation, the switch rotating member pivots clockwise or counter-clockwise, and is maintained in its respective position by application of the appropriate electric field. Impedance matching to circuits connected to the F1 and F2 In and Out traces can be accomplished using low-resistance contacts and structures, such as contacts A, B and C.

Figure 3A:
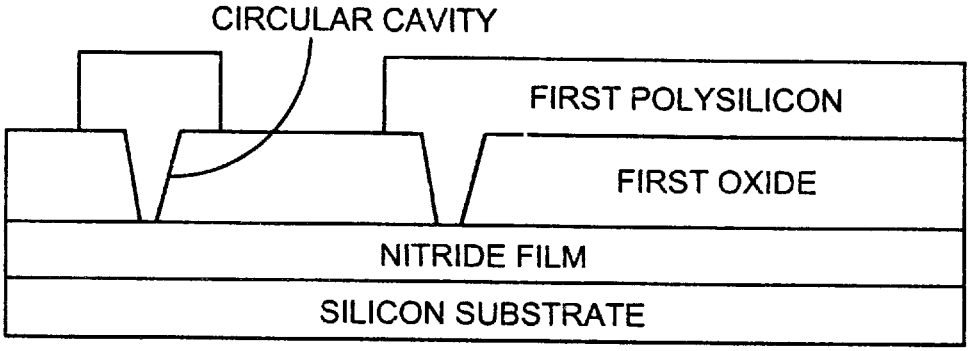
FIGS. 3*a* through 3*d* are process drawings indicating fabrication steps forming a rotating member on a standoff bearing on a substrate.

Referring to all of the Figures, and particularly FIGS. 3*a* through 3*d*, cross-sections of a wafer are shown at various stages of the switch fabrication process. The substrate has a nitride layer disposed upon a silicon substrate. The nitride film is used to electrically isolate the switch structures from the substrate. A first sacrificial oxide layer is disposed upon the nitride film. A circular cavity is patterned into the first oxide layer to define a circular standoff bearing. A first polysilicon layer is disposed over the first oxide layer for forming the rotating switch member and for forming the circular standoff bearing portion upon which the rotating switch member is to be supported above the substrate. This is shown in FIG. 3*a*.

Figure 3B:
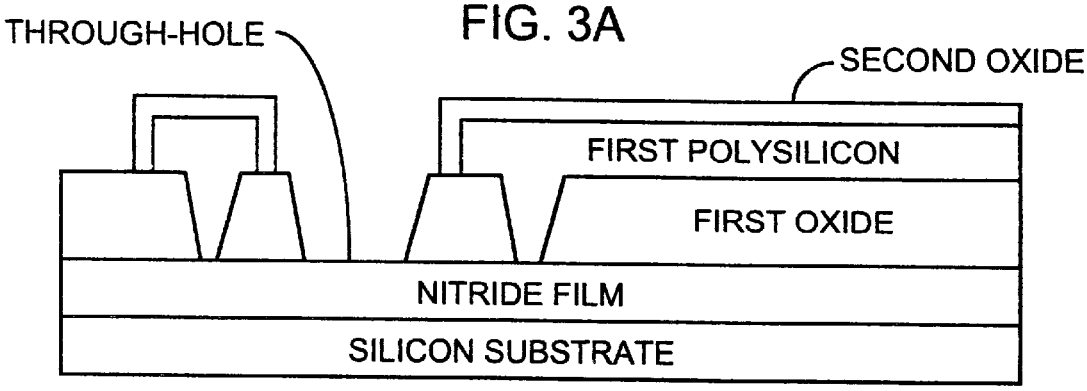
Figure 3C:
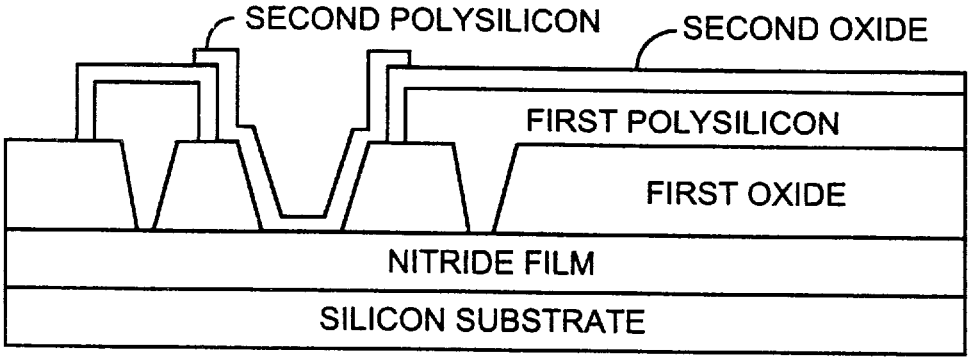
Figure 3D:
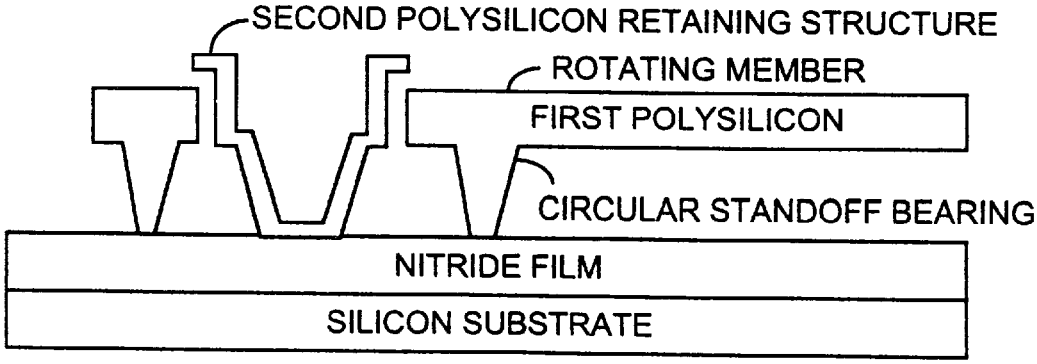

A precision through-hole is then etched into the first oxide layer for defining a center retaining structure. The rotating switch member is to be supported by the circular standoff bearing and rotated about the retaining structure. The retaining structure further functions to anchor the rotating switch member to the substrate. Next, a second oxide sacrificial layer is deposited over the first polysilicon layer for masking the first polysilicon layer, as shown in FIG. 3*b*. Then, a second polysilicon layer is disposed over the precision through-hole, forming a bushing during fabrication of the retaining structure about which the rotating switch member will pivot, shown in FIG. 3*c*. Finally, in FIG. 3*d*, the first and second sacrificial oxide layers are dissolved to release the rotating switch member from the substrate, freeing it to rotate about the center retaining structure. Wires, ribbon bonds or probes, all not shown, may be used to deliver the necessary electrical voltage signals to the control traces to rotate the rotating switch member as desired. The contacts are conductors, preferably metal, such as gold, silver or aluminum and formed in the rotating switch member using conventional processing methods.

The integrated micromachined switch could be deployed in applications such as front ends for specialized mobile data and satellite receivers, cellular data transceivers, wireless local area networks, personal digital assistants, and portable data collection terminals. The F1 and F2 output traces may be part of parallel-coupled band-pass filters, but various other circuit connection configurations and filters could be used with the switch. For example, the two input traces could be connected to respective frequency sources, and the F1 and F2 output traces, could be connected to respective filters, so that the output traces would carry one of the two signal frequencies, depending on the switch position. Thus, the two micromachined filters, not shown, could be combined with the switch to create part of a dual-frequency receiver front-end.

The MEMS switch is shown with a "T" shaped rotating member with rectangular contacts, but other configurations and geometries could be used. The F1 and F2 stops may be made of polysilicon, but other processing materials may be used. The MEMS switch is a highly-compact, integrated switch well suited for volume production of monolithic modules and receiver front-ends for a variety of applications. One application is to combine a micromachined MEMS switch with planar filters for dual-frequency monolithic millimeter wave receiver applications. The MEMS switch can be used to eliminate interfaces and connectors between dissimilar device types, thus mitigating the attendant likely signal loss, in addition to reducing size. Those skilled in the art can make enhancements, improvements and modifications to enhance the invention. However, those enhancements, improvements and modifications may nonetheless fall within the spirit and scope of the following claims.

What is claimed is:

1. A switch for providing electrical connections on a substrate, the switch comprising, a first input trace disposed on the substrate, a first output trace disposed on the substrate, a retaining structure disposed on the substrate, a first control trace disposed on the substrate for carrying a first electrostatic signal, a second control trace disposed on the substrate for carrying a second electrostatic signal, a rotating member integrally having a circular standoff bearing disposed on the substrate, the rotating member entirely supported by the circular standoff bearing for bidirectionally rotating and maintaining the rotating member between a first position and a second position, the rotating member rotating about the retaining structure and rotating with the circular standoff bearing, the rotating member is rotated to the first position when the first electrostatic signal is active and rotated to the second position when the second electrostatic signal is active, the rotating member connects the first input trace to the first output trace when in the first position and disconnects the first input trace from the first output trace when in the second position.

2. The switch of claim 1 further comprising, a nitride layer disposed on the substrate for electrically isolating the rotating member from the substrate.

3. The switch of claim 1 further comprising, a second input trace disposed on the substrate, a second output trace disposed on the substrate, the rotating member connects the second input trace to the second output trace when in the second position and disconnects the second input trace from the second output trace when in the first position.

4. The switch of claim 1 further comprising, a first stop disposed on the substrate for stopping the rotation of the rotating member at the first position when the first electrostatic signal is active.

5. The switch of the claim 1 further comprising, a second stop disposed on the substrate for stopping the rotation of the rotating member at the second position when the second electrostatic signal is active.

6. The switch of claim 1 further comprising, a first contact disposed in the rotating switch member at a first point, a second contact disposed in the rotating switch member at a second point, the first contact provides electrical connection between the rotating switch member and the first input trace, the second contact provides electrical connection between the rotating switch member and the first output trace, both for enhancing electrical conduction through the rotating switch member between the first input trace and the first output trace.

* * * * *